US012302993B2

(12) United States Patent
Kanematsu

(10) Patent No.: US 12,302,993 B2
(45) Date of Patent: May 20, 2025

(54) FOOTWEAR

(71) Applicant: ASICS CORPORATION, Kobe (JP)

(72) Inventor: Kei Kanematsu, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/460,510

(22) Filed: Sep. 1, 2023

(65) Prior Publication Data

US 2024/0074538 A1 Mar. 7, 2024

(30) Foreign Application Priority Data

Sep. 5, 2022 (JP) ..... 2022-140691

(51) Int. Cl.

| | |
|---|---|
| ***A43C 1/04*** | (2006.01) |
| ***A43C 1/00*** | (2006.01) |
| ***A43C 11/00*** | (2006.01) |
| ***A43C 11/14*** | (2006.01) |

(52) U.S. Cl.

CPC ..... *A43C 1/04* (2013.01); *A43C 11/008* (2013.01); *A43C 11/1493* (2013.01); *A43C 1/003* (2013.01)

(58) Field of Classification Search

CPC ..... A43C 1/04; A43C 1/003; A43C 11/1493; A43C 11/008; A43B 3/06

USPC ..... 36/50.1

See application file for complete search history.

(56) References Cited

U.S. PATENT DOCUMENTS

| | | | | |
|---|---|---|---|---|
| 2,369,254 A * | 2/1945 | Roman | A43C 1/04 | 36/50.1 |
| 4,414,761 A * | 11/1983 | Mahood | A43C 1/00 | 24/712 |
| 5,692,319 A * | 12/1997 | Parker | A43C 1/00 | 36/114 |
| 6,757,991 B2 * | 7/2004 | Sussmann | A43C 11/008 | 36/50.1 |

(Continued)

FOREIGN PATENT DOCUMENTS

| | | |
|---|---|---|
| EP | 1 525 814 A1 | 4/2005 |
| JP | 2021-520918 A | 8/2021 |

(Continued)

OTHER PUBLICATIONS

The extended European search report issued by the European Patent Office on Jan. 23, 2024, which corresponds to European Patent Application No. 231951245-1015 and is related to U.S. Appl. No. 18/460,510.

*Primary Examiner* — Jocelyn Bravo

(74) *Attorney, Agent, or Firm* — Studebaker Brackett PLLC

(57) ABSTRACT

A footwear includes: a sole; an upper located above the sole to accommodate a foot; a loop engagement portion located on at least one of a medial face or a lateral face of the footwear, fixed to one of the sole, the upper, or an interface between the sole and the upper, and including a plurality of loops, and extending from a lower side toward an upper side; a loop tightening part including a single loop passing through the plurality of loops of the loop engagement portion; a fixing portion disposed in the loop tightening part; and a fixed portion which is disposed on the upper or the sole and to which the fixing portion is fixed. In a state where the loop engagement portion is pulled by the loop tightening part, the fixing portion is fixable to the fixed portion.

13 Claims, 10 Drawing Sheets

(56) References Cited

U.S. PATENT DOCUMENTS

| | | | | |
|---|---|---|---|---|
| 8,661,631 | B2 * | 3/2014 | Palea | A43C 7/00 24/304 |
| 10,390,584 | B2 * | 8/2019 | Fuerst, Jr. | A43B 13/223 |
| 10,827,803 | B2 | 11/2020 | Bell et al. | |
| 11,206,898 | B2 * | 12/2021 | Cobb | A43C 1/06 |
| 2003/0167655 | A1 * | 9/2003 | Sussmann | A43C 11/008 36/50.1 |
| 2007/0039145 | A1 * | 2/2007 | Palea | A43C 11/24 24/712.4 |
| 2007/0277398 | A1 * | 12/2007 | Davis | A43B 1/0081 36/50.1 |
| 2013/0152425 | A1 * | 6/2013 | Borel | A43C 11/00 36/83 |
| 2017/0202296 | A1 * | 7/2017 | Fuerst, Jr. | A43B 23/0295 |
| 2019/0116936 | A1 * | 4/2019 | Aceves Tinajero | A43B 9/00 |
| 2019/0365017 | A1 * | 12/2019 | Sandy | A43C 11/008 |
| 2021/0022447 | A1 * | 1/2021 | Cobb | A43C 1/04 |
| 2021/0153605 | A1 | 5/2021 | Hopkins | |

FOREIGN PATENT DOCUMENTS

| | | | |
|---|---|---|---|
| WO | 2019/199511 | A1 | 10/2019 |
| WO | 2022/254295 | A1 | 12/2022 |

* cited by examiner

FOOTWEAR

CROSS-REFERENCE TO RELATED APPLICATIONS

This application claims benefit of priority to Japanese Patent Application No. 2022-140691 filed Sep. 5, 2022, the entire contents of which are incorporated herein by reference.

TECHNICAL FIELD

The present teaching relates to a footwear.

BACKGROUND

Footwears that can be easily put on and off are known. Patent Literature 1, for example, discloses a footwear that facilitates relatively easy insertion and removal and secures tightening. This footwear includes a sole structure, an upper fixed to the sole structure, and a plurality of tensioning cables having proximal ends fixed to at least one of the upper or the sole structure and extending out of the upper. The footwear is configured such that a strap has a proximal end connected to distal ends of the plurality of tensioning cables and also has a distal end releasably securable to the upper to tighten the tensioning cables.

In the footwear described in Patent Literature 1, the plurality of tensioning cables extend to one of instep portions of a midfoot region of the upper, and the plurality of tensioning cables are respectively inserted in a plurality of looped cables provided in the other instep portion of the midfoot region of the upper, and the plurality of tensioning cables are connected to a strap.

In the footwear described above, the upper can be easily tightened by loosening the strap to which the plurality of tensioning cables are connected to loosen the upper, inserting a foot into the footwear, pulling the strap, and then tightening the plurality of tensioning cables to fix the tensioning cables to the upper.

PRIOR ART

Patent Literature

Patent Literature: U.S. Pat. No. 10,827,803

SUMMARY

Inventors of the present teaching studied a structure that eases putting on and off of a footwear and obtains effective tightening. To ease putting on and off of a footwear, it is preferable to easily loosen and tighten an upper. In particular, for a person having difficulty in putting on and off lace-up footwears, it is desired that the upper can be greatly loosened and easily tightened with one hand.

Inventors of the present teaching studied a footwear that is easily put on and off and enables effective tightening of the footwear. Through an intensive study, the inventors conceived the following structure.

A footwear according to one embodiment of the present teaching includes: a sole; an upper provided above the sole to accommodate a foot; a loop engagement portion located on at least one of a medial face or a lateral face of the footwear, fixed to one of the sole, the upper, or an interface between the sole and the upper, and including a plurality of loops extending from a lower side toward an upper side; a loop tightening part including a single loop passing through the plurality of loops of the loop engagement portion; a fixing portion disposed in the loop tightening part; and a fixed portion which is disposed on the upper or the sole and to which the fixing portion is fixed, wherein in a state where the loop engagement portion is pulled by the loop tightening part, the fixing portion is fixable to the fixed portion.

One embodiment of the present teaching eases putting on and off of the footwear by loosening the loop tightening part including the single loop. In addition, the loop engagement portion and the loop tightening part tighten a wide range of a foot inserted in an upper, and thus, the upper can be effectively tightened independently of an instep shape of a person.

BRIEF DESCRIPTION OF DRAWINGS

FIG. 7 is a side view of the lateral face side illustrating a state where the footwear according to the embodiment of the present teaching is put on.

DESCRIPTION OF EMBODIMENTS

Figure 1:
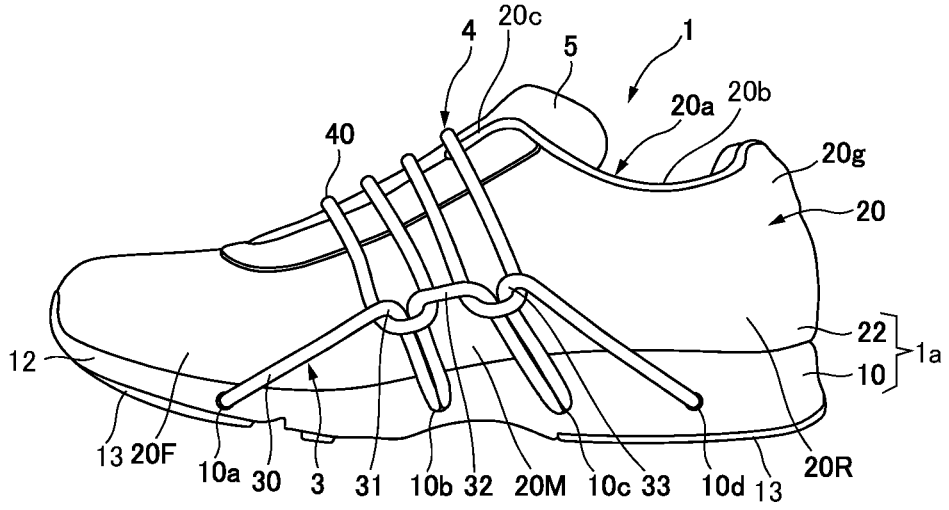
FIG. 1 is a side view illustrating a medial face side of a footwear according to an embodiment of the present teaching.

In the following description, for purposes of explanation, numerous specific details are set forth in order to provide a thorough understanding of the present teaching. It is obvious that those skilled in the art, however, would be able to carry out the present teaching without these specific examples.

The present disclosure is to be, therefore, considered as an exemplification of the invention, and is not intended to limit the invention to the specific embodiments illustrated by the figures or description below.

A footwear according to an embodiment of the present teaching will be specifically described hereinafter with reference to the drawings. The footwear according to the present teaching is not limited to those described in the following embodiment, and can be carried out with an appropriate change without departing from the gist of the invention.

In the embodiment and modifications of the present teaching, like reference characters denote like or corresponding constituting elements and members, and the same description will be omitted as appropriate. Also, the dimensions of a member may be appropriately enlarged or reduced in each drawing in order to facilitate understanding. Further, in each drawing, part of a member less important in describing the embodiment may be omitted.

Also, terms including ordinal numbers, such as "first" and "second", are used to describe various constituting elements; however, such terms are used in order to distinguish one constituting element from another and do not limit the constituting elements.

Embodiment

Figure 2:
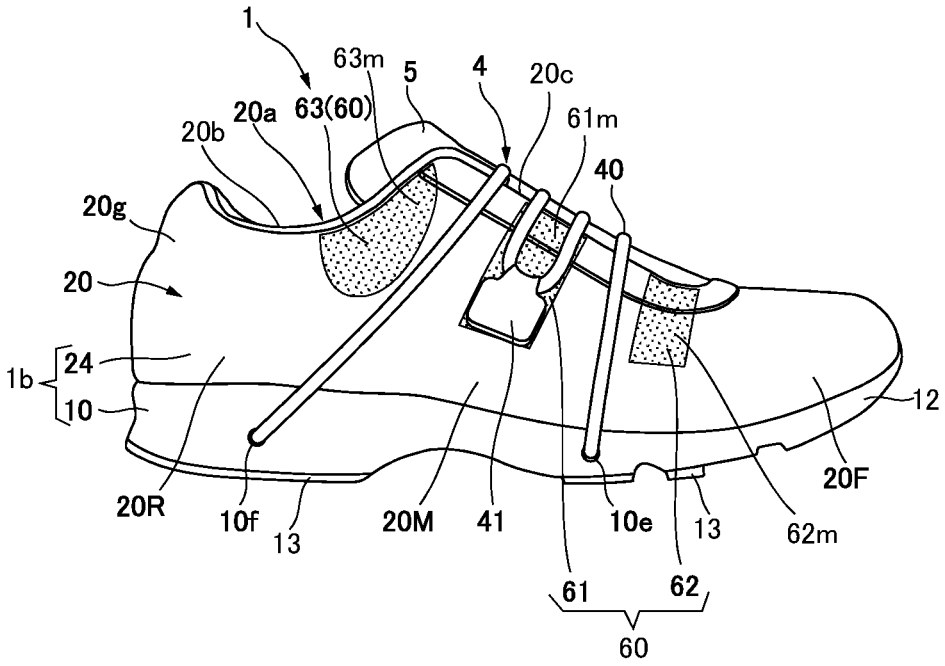
FIG. 2 is a side view illustrating a lateral face side of the footwear according to the embodiment of the present teaching.
Figure 3:
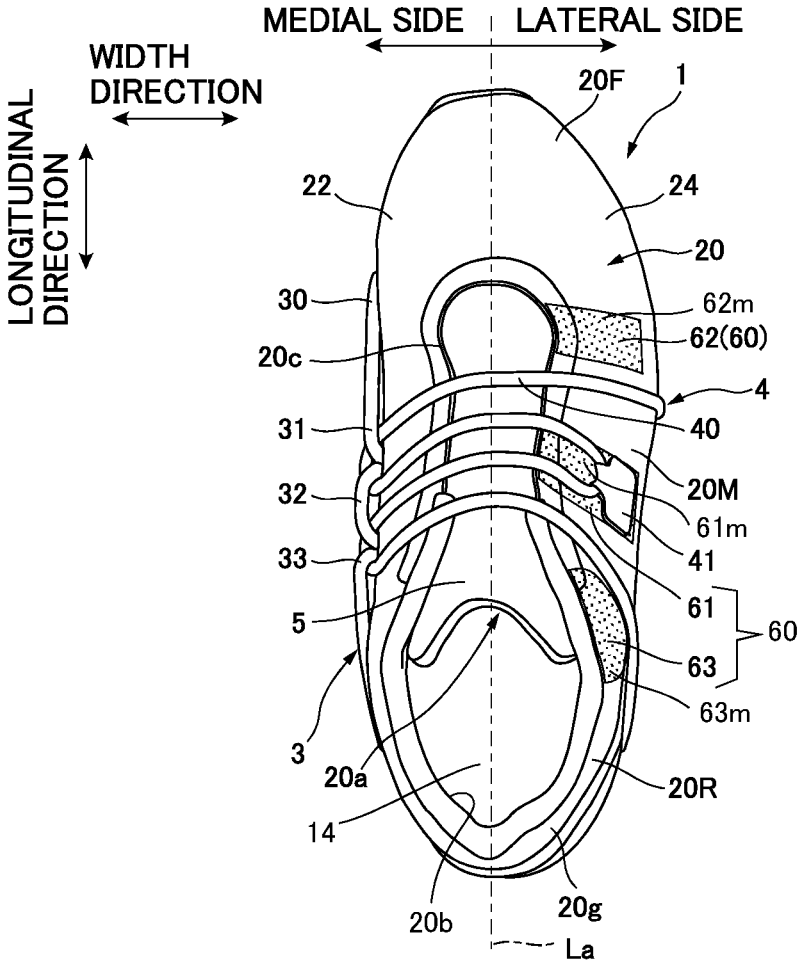
FIG. 3 is a plan view of the footwear according to the embodiment of the present teaching and illustrates a state where a fixing portion of a loop tightening part is fixed to a fixed portion.
Figure 4:
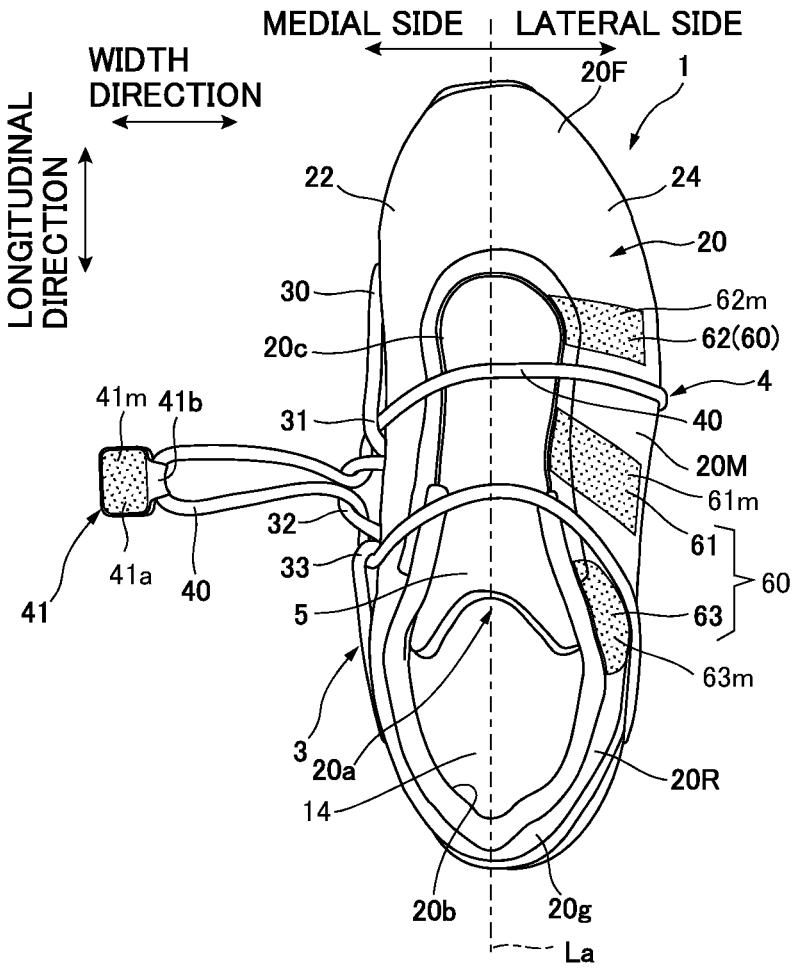
FIG. 4 is a plan view of the footwear according to the embodiment of the present teaching and illustrates a state where the fixing portion of the loop tightening part is released from the fixed portion.
Figure 5:
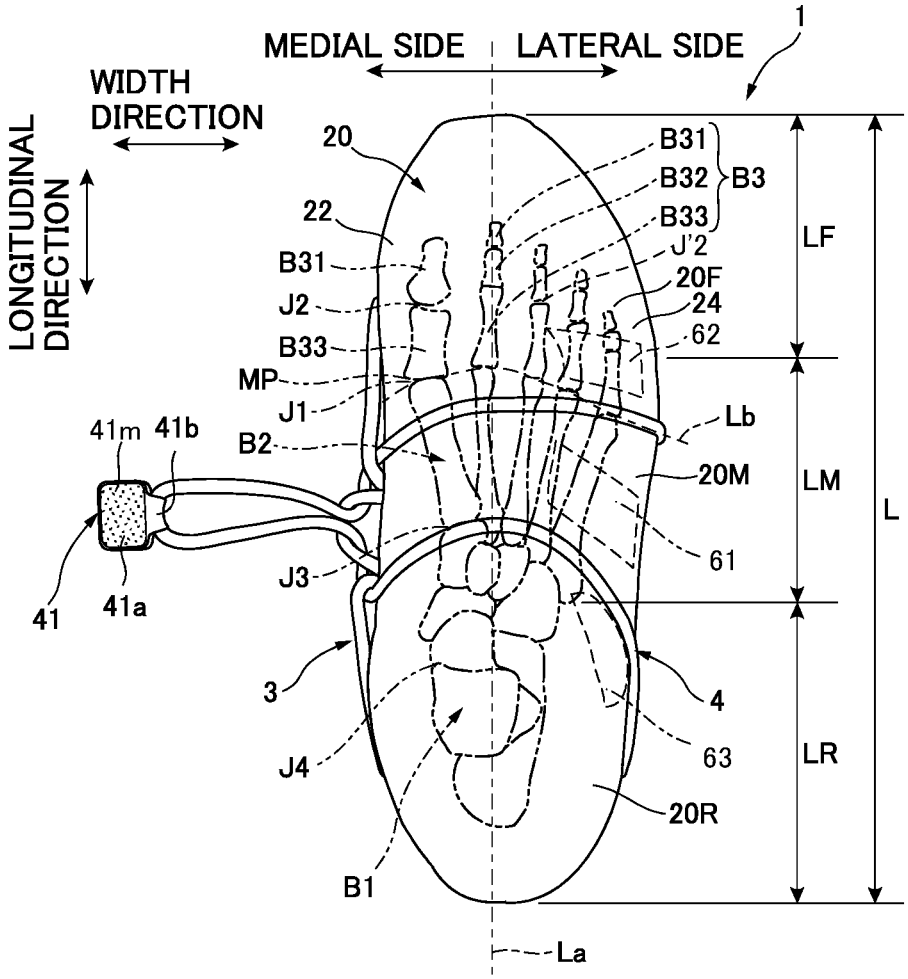
FIG. 5 is a schematic view illustrating a positional relationship between the footwear according to the embodiment of the present teaching and a foot skeleton of a wearer.

In the following, a configuration of a footwear 1 according to an embodiment of the present teaching will be described with reference to the drawings. FIG. 1 is a side view illustrating a medial face side of the footwear 1 according to the embodiment of the present teaching. FIG. 2 is a side view illustrating a lateral face side of the footwear 1 according to the embodiment of the present teaching. Each drawing mentioned below, including FIGS. 1 and 2, illustrates a footwear for a right foot, unless otherwise specified. However, the description in the present specification is also applicable to a footwear 1 for a left foot. FIG. 3 is a plan view of the footwear according to the embodiment of the present teaching and illustrates a state where a fixing portion of a loop tightening part is fixed to a fixed portion. FIG. 4 is a plan view of the footwear according to the embodiment of the present teaching and illustrates a state where the fixing portion of the loop tightening part is released from the fixed portion. FIG. 5 is a schematic view illustrating a positional relationship between the footwear according to the embodiment of the present teaching and a foot skeleton of a wearer.

The footwear 1 of the present embodiment can be used for walking footwears, running footwears, safety footwears, sports footwears for tennis, basketball, and other sports, and sandals, for example, and the use of the footwear 1 is not limited. The footwear 1 includes a sole 10 and an upper 20. As illustrated in FIGS. 3 through 5, a portion on the medial side (the left side in the drawings) with respect to a center line La in a width direction of the upper 20 will be referred to as a medial portion 22, and a portion on the lateral side (the right side in the drawings) with respect to the center line La in the width direction will be referred to as a lateral portion 24.

In the present teaching, as illustrated in FIG. 1, a medial face 1*a* of the footwear 1 includes a medial side of the sole 10 and the medial portion 22 of the upper 20, and as illustrated in FIG. 2, a lateral face 1*b* of the footwear 1 includes a lateral side of the sole 10 and the lateral portion 24 of the upper 20.

In the present teaching, the direction from the lateral side toward the medial side of the footwear will be referred to as the inner side, and the opposite direction will be referred to as the outer side. Further, a direction along the center line La will be referred to as a "longitudinal direction". The direction toward the toe side along the center line La will be referred to as the "front side" or "front", and the opposite direction will be referred to as the "rear side" or "rear". Accordingly, the width direction is perpendicular to the center line La.

In the present teaching, in a state where the footwear 1 is placed on a horizontal plane (hereinafter, referred to as a "horizontal state"), the upper side will be referred to as the "upper side" or "above", and the opposite side will be referred to as the "lower side" or "below". Also, in the horizontal state, a direction extending vertically will be referred to as a "vertical direction".

In the present teaching, as illustrated in FIGS. 3 through 5, a portion of the upper 20 corresponding to the metatarsal bones B2 (see FIG. 5) in the longitudinal direction will be referred to as a midfoot portion 20M. When the longitudinal length L of the footwear 1 is regarded as 100%, the midfoot portion 20M corresponds to a region from 25% to 85% or, more exactly, from 30% to 80%, from the tip, in a range parallel with a straight line perpendicular to the center line La, and is a region of a length LM. A portion of the upper 20 in the front of the midfoot portion 20M in the longitudinal direction will be referred to as a forefoot portion 20F, and is a region of a length LF. Also, a portion of the upper 20 in the rear of the midfoot portion 20M will be referred to as a rearfoot portion 20G, and is a region of a length LR. The forefoot portion 20F is a portion that almost corresponds to phalanges B3 (see FIG. 5), and the rearfoot portion 20G is a portion that almost corresponds to tarsals B1 (see FIG. 5).

As illustrated in FIG. 5, a foot is constituted by the tarsals B1, first through fifth metatarsal bones B2, and the phalanges B3. The phalanges B3 are constituted by a proximal phalanx B33, a middle phalanx B32, and a distal phalanx B31. The bones are denoted in the order by first, second, third, fourth, and fifth, from the left in FIG. 5. Foot joints are constituted by an IP joint J2, a PIP joint J'2, a metatarsophalangeal joint (MP joint) J1, a Lisfranc joint J3, and a Chopart joint J4. In FIG. 5, an imaginary line along the MP joint is denoted by Lb.

(Sole)

The sole 10 is a portion to be in contact with the ground. The sole 10 includes a midsole 12, an outsole 13, and an insole 14. Above the sole 10, the upper 20 is fixed by means of bonding or the like. The sole 10 may have a unisole structure and need not necessarily include the insole 14.

(Upper)

The upper 20 is provided above the sole 10 to accommodate a foot. The upper 20 surrounds an internal space 20*a* for accommodating the foot. On the upper 20, a wearing opening 20*b* through which the foot is to be inserted is formed. At the rear of the wearing opening 20*b*, an upper heel portion 20*g* for covering the heel of the foot is provided. A central opening 20*c* is formed forward of the wearing opening 20*b*. The central opening 20*c* is closed with a tongue 5. The tongue 5 is sewn to the upper 20 forward of the central opening 20*c*. The central opening 20*c* is not an essential configuration, and the upper 20 may have a so-called monosock structure.

The upper 20 includes a fixed portion 60 to which a fixing portion 41 of a loop tightening part 4 described later is fixed. In the present embodiment, the fixed portion 60 is constituted by a first fixed member 61, a second fixed member 62, and a third fixed member 63 that are provided at three different positions of the upper 20.

The fixing portion 41 of the loop tightening part 4 is fixed to one of the first fixed member 61, the second fixed member 62, or the third fixed member 63. In the present embodiment, each of the first fixed member 61, the second fixed member 62, the third fixed member 63, and the fixing portion 41 is a hook-and-loop fastener. The fixed portion 60 (the first fixed member 61, the second fixed member 62, and the third fixed member 63) and the fixing portion 41 only have to be capable of fixing and releasing, and may be a key hook, a spring hook, a buckle, or the like, as well as the hook-and-loop fastener.

In the present embodiment, the first fixed member 61 is provided in the midfoot portion 20M of the upper 20, the second fixed member 62 is provided in the forefoot portion 20F of the upper 20, and the third fixed member 63 is provided in the rearfoot portion 20R of the upper 20.

In the present embodiment, as illustrated in FIG. 3, an upper end of the first fixed member 61 is constituted by a rectangular first hook-and-loop fastener 61*m* extending from a vicinity of the central opening 20*c* toward the sole 10. An upper end of the second fixed member 62 is constituted by a rectangular first hook-and-loop fastener 62*m* extending from a vicinity of the central opening 20*c* toward the sole 10. An upper end of the third fixed member 63 is constituted by a semicircular first hook-and-loop fastener 63*m* extending from a vicinity of the wearing opening 20*b* toward the sole 10. As illustrated in FIG. 5, a portion of the second fixed member 62 extends from the forefoot portion 20F across the midfoot portion 20M.

There are variations in human instep shapes. The fixed portion 60 that is, the first fixed member 61, the second fixed member 62, and the third fixed member 63 are provided at a plurality of positions in the upper 20 so that the fixed portion 60 constituted by the fixed members 61, 62, and 63 provided at a plurality of positions for fixing the fixing portion 41 can be selected in accordance with instep shapes of various persons. In the present embodiment, an optimum fastening force can be obtained in accordance with instep shapes of various persons.

In the present embodiment, although the first fixed member 61, the second fixed member 62, and the third fixed member 63 as the fixed portion 60 are provided at different positions of the upper 20, the fixed portion 60 may be provided only at one position. In the present embodiment, the fixed portion 60 that is, the first fixed member 61, the second fixed member 62, and the third fixed member 63 are provided at three positions of the upper 20, but positions where the fixed portion is provided are not limited to three portions, and may be two or four or more.

(Loop Engagement Portion)

A loop engagement portion 3 applies a fastening force to the upper 20 together with the loop tightening part 4. The loop engagement portion 3 is located at least one of the medial face 1*a* or the lateral face 1*b* of the footwear 1. The loop engagement portion 3 of the present embodiment is located on the medial face 1*a* of the footwear 1. The loop engagement portion 3 is fixed to one of the sole 10, the upper 20, or an interface between the sole 10 and the upper 20. In the present embodiment, the loop engagement portion 3 is fixed to the sole 10 near the upper 20. The loop engagement portion 3 includes a plurality of loops extending from a lower side toward an upper side. In the present embodiment, three loops are arranged in the order of a first loop 31, a second loop 32, and a third loop 33 from a front side toward a rear side of the footwear 1.

A loop as used herein refers to a member formed by folding back and having, for example, a semicircular shape or a U-shaped or V-shaped peak or valley. The loop does not need to be closed, and may be partially open.

In the present embodiment, the loop engagement portion 3 is fixed to the sole 10, but may be fixed to an interface between the sole 10 and the upper 20 or to the upper 20.

In the present embodiment, as illustrated in FIG. 1, the loop engagement portion 3 is constituted by a string-like member 30 such as a shoelace. One end of the string-like member 30 is inserted in a hole 10*a* provided in a front portion of the sole 10, and the string-like member 30 is fixed with an adhesive or the like.

The string-like member 30 extends upward form the first hole 10*a* and is folded at a predetermined position to form the first loop 31. After forming the first loop 31, the string-like member 30 extends downward toward a second hole 10*b* provided rearward of the first hole 10*a* in the sole 10, is inserted in the second hole 10*b*, is folded back in the second hole 10*b*, and is fixed with an adhesive or the like.

The string-like member 30 extends upward from the second hole 10*b* and is folded at a predetermined position to form the second loop 32. After forming the second loop 32, the string-like member 30 extends downward toward a third hole 10*c* provided rearward of the second hole 10*b* in the sole 10, is inserted in the third hole 10*c*, is folded back in the third hole 10*c*, and is fixed with an adhesive or the like.

The string-like member 30 then extends upward from the third hole 10*c* and is folded at a predetermined position to form the third loop 33. After forming the third loop 33, the string-like member 30 extends downward toward a fourth hole 10*d* provided rearward of the third hole 10*c* in the sole 10, and the other end of the string-like member 30 is inserted in the fourth hole 10*d* and fixed with an adhesive or the like.

In this manner, the first loop 31, the second loop 32, and the third loop 33 are disposed on the medial face 1*a* of the footwear 1. The loop engagement portion 3 is constituted by the string-like member 30 so that one end of the string-like member 30 is inserted and fixed in the first hole 10*a* of the sole 10 and then inserted in the second hole 10*b* and the third hole 10*c* while sequentially forming loops, and the other end of the string-like member 30 is inserted and fixed in the fourth hole 10*d*. In this manner, a plurality of loops can be easily arranged on the medial face 1*a* of the footwear 1.

In the present embodiment, the first loop 31, the second loop 32, and the third loop 33 of the loop engagement portion 3 are disposed in the midfoot portion 20M. In this manner, the plurality of loops of the loop engagement portion 3 are disposed in the midfoot portion 20M so that a foot can be tightened about the midfoot portion 20M of the footwear 1. In the present embodiment, the three loops are disposed in the midfoot portion 20M, but the effect of tightening a foot about the midfoot portion 20M of the footwear 1 can also be obtained by disposing two loops in the midfoot portion 20M.

As illustrated in FIGS. 1 and 5, in the present embodiment, a front endpoint of the first loop 31 at the forefront in the longitudinal direction among the plurality of loops of the loop engagement portion 3 is located forward of a portion of the footwear 1 corresponding to a MP joint (line Lb in FIG. 5) in the longitudinal direction. In addition, a rear endpoint of the third loop 33 at the rearmost in the longitudinal direction is located in the rearfoot portion 20R. In this manner, the loop engagement portion 3 is disposed at front and rear positions including the midfoot portion 20M so that the upper 20 can be thereby tightened in a wide range.

In the present embodiment, peak heights of the plurality of loops (the first loop 31, the second loop 32, and the third loop 33) gradually increase from the forefoot portion 20F toward the rearfoot portion 20R. The peak heights of the loops increase in the order of the first loop 31, the second loop 32, and the third loop 33. The instep becomes higher from the toe toward the heel, and thus, the peak heights of the loops are increased in accordance with the height of the instep. Accordingly, the upper 20 can be tightened such that the first loop 31, the second loop 32, and the third loop 33 of the loop engagement portion 3 extend along the instep. The peak heights of the plurality of loops (the first loop 31, the second loop 32, and the third loop 33) may be parallel to a plane on which the sole is grounded.

(Loop Tightening Part)

The loop tightening part 4 tightens the upper 20 by pulling the loop engagement portion 3 and applying a fastening force of closing the central opening 20*c* in the width direction. The loop tightening part 4 includes a single loop passing through the first loop 31, the second loop 32, and the third loop 33 that are the plurality of loops of the loop engagement portion 3. That is, the loop tightening part 4 forms a single loop while being interwoven in the first loop 31, the second loop 32, and the third loop 33 of the loop engagement portion 3. The loop tightening part 4 includes the fixing portion 41 to be fixed to the fixed portion 60. In a state where the loop engagement portion 3 is pulled by the loop tightening part 4, the fixing portion 41 can be fixed to the fixed portion 60.

The single loop herein refers to constituting one loop from one end to the other end of the loop. The loop does not need to be closed, and may be partially open.

The first loop 31, the second loop 32, and the third loop 33 of the loop engagement portion 3 are individually pulled upward by pulling the loop tightening part 4 upward, and a tightening force is applied to the entire loop engagement portion 3. In this state, the fixing portion 41 is fixed to the fixed portion 60. Accordingly, the upper 20 can be tightened by the loop engagement portion 3 and the loop tightening part 4 in a wide range from a sole to an instep of a foot 8 inserted in the upper 20.

In putting the footwear 1 off, the fixing portion 41 is detached from the fixed portion 60 so that portions of the loop tightening part 4 interwoven in the loops 31, 32, and 33 of the loop engagement portion 3 can be easily loosened, tightening of the upper 20 is released, and the foot 8 can be easily put off from the upper 20. Accordingly, the footwear 1 of the present embodiment can be easily put off. In the manner described above, tightening of the upper 20 can be loosened by one action of detaching the fixing portion 41 from the fixed portion 60.

As illustrated in FIGS. 2 through 4, in the present embodiment, the loop tightening part 4 is located on the lateral face 1*b* of the footwear 1 opposite to face of the footwear 1 on which the loop engagement portion 3 is disposed. One end of the loop tightening part 4 is fixed to one of the sole 10, the upper 20, or an interface between the sole 10 and the upper 20 on the lateral face 1*b* of the footwear 1. In the present embodiment, the end of the loop tightening part 4 is fixed to the sole 10 near the upper 20 on the lateral face 1*b* of the footwear 1.

In the present embodiment, the loop tightening part 4 is fixed to the sole 10, but may be fixed to an interface between the sole 10 and the upper 20 or to the upper 20.

The loop tightening part 4 extends from the sole 10 toward the upper 20, and extends into the medial portion 22 of the upper 20. The loop tightening part 4 is interwoven in the first loop 31, the second loop 32, and the third loop 33 of the loop engagement portion 3 located in the medial portion 22 of the upper 20. Then, the loop tightening part 4 that has passed through the third loop 33 returns to the lateral portion 24 of the upper 20, and the other end of the loop tightening part 4 is fixed to the sole 10 near the upper 20 on the lateral face 1*b* of the footwear 1.

The loop tightening part 4 includes the fixing portion 41 to be fixed to the fixed portion 60 provided on the upper 20. In the present embodiment, the fixing portion 41 is provided in the loop tightening part 4 interwoven in the second loop 32. The fixing portion 41 includes an attachment portion 41*b* to be attached to a rectangular body portion 41*a* and the loop tightening part 4. In the present embodiment, the fixing portion 41 is attached to the loop tightening part 4 through the attachment portion 41*b* so that the fixing portion 41 can freely move on the loop tightening part 4. Since the fixing portion 41 is movably attached to the loop tightening part 4, even when the tensile direction of the loop tightening part 4 including a single loop is changed in accordance with, for example, the height of the instep, the fixing portion 41 moves to an appropriate position on the loop tightening part 4 and a tensile force of the loop tightening part 4 in multiple directions is not impaired.

In the present embodiment, a second hook-and-loop fastener 41*m* is disposed on the body portion 41*a* of the fixing portion 41. The second hook-and-loop fastener 41*m* of the fixing portion 41 is configured to be fixed or open with respect to the first hook-and-loop fasteners 61*m*, 62*m*, and 63*m* of the fixed portion 60.

One of the first hook-and-loop fasteners 61*m*, 62*m*, and 63*m* of the fixed portion 60 or the second hook-and-loop fastener 41*m* of the fixing portion 41 has a hook surface, and the other has a loop surface. Accordingly, the second hook-and-loop fastener 41*m* is detachable from the first hook-and-loop fasteners 61*m*, 62*m*, and 63*m*. The upper 20 is tightened by fixing the second hook-and-loop fastener 41*m* to the first hook-and-loop fasteners 61*m*, 62*m*, and 63*m*. The tightening of the upper 20 is canceled by detaching the second hook-and-loop fastener 41*m* from the first hook-and-loop fasteners 61*m*, 62*m*, and 63*m*.

In the present embodiment, as illustrated in FIGS. 1 and 2, the loop tightening part 4 is constituted by the string-like member 40 such as a shoelace. One end of the string-like member 40 is inserted in a hole 10*e* provided in a front portion of the sole 10 and in the lateral face 1*b* opposite to the medial face 1*a* as a side face on which the loop engagement portion 3 is located, and the string-like member 40 is fixed with an adhesive or the like. The string-like member 40 passes while being interwoven in the first loop 31, the second loop 32, and the third loop 33. The other end of the string-like member 40 is inserted in a hole 10*f* provided in a rear portion of the sole 10 and in the lateral face 1*b*, and is fixed with an adhesive or the like. In the present embodiment, one end and the other end of the string-like member 40 constituting the loop tightening part 4 are fixed to the sole 10.

In the present embodiment, the string-like member 40 of the loop tightening part 4 is guided to the medial face 1*a* on which the loop engagement portion 3 is located, from the lateral face 1*b* opposite to the medial face 1*a* on which the loop engagement portion 3 is disposed. Then, the string-like member 40 passes through the first loop 31 and the third loop 33 located at the front and the rear, respectively, in the longitudinal direction among the three loops, and is folded back toward the lateral face 1*b* opposite to the medial face 1*a* on which the loop engagement portion 3 is located. The string-like member 40 passes through the second loop 32 at the middle in the longitudinal direction among the three loops, and the fixing portion 41 is provided at a portion of the loop tightening part 4 that has passed through the middle second loop 32.

In the present embodiment, the attachment portion 41*b* of the fixing portion 41 is configured to allow the string-like member 40 to pass therethrough, and the fixing portion 41 is movably attached to the loop tightening part 4.

The string-like member 30 of the loop engagement portion 3 and the string-like member 40 of the loop tightening part 4 may be made of the same material or different materials, and materials that cause less friction between these string-like members are preferable. Each of the string-like members 30 and 40 may be made of a material having a circular, oval, or substantially rectangular cross section or a band-shaped material, and materials for the string-like members 30 and 40 are not limited to materials used for shoelaces, and a flexible resin material, a metal material such as a wire, or other materials may be used.

With reference to FIGS. 3 and 4, the footwear 1 using the loop engagement portion 3 and the loop tightening part 4 will be further described. In the present embodiment, the loop engagement portion 3 located on the medial face 1*a* of the footwear 1 includes the first loop 31, the second loop 32, and the third loop 33, as a plurality of loops. The loop engagement portion 3 is inserted in the holes 10*a*, 10*b*, 10*c*, and 10*d* disposed in the sole 10 near the upper 20, and is fixed with an adhesive or the like to be fixed at four positions of the sole 10.

The loop tightening part 4 located on the lateral face 1*b* of the footwear 1 is inserted in the holes 10*e* and 10*f* disposed in the sole 10 near the upper 20, and is fixed with an adhesive or the like to be fixed at two positions of the sole 10.

The string-like member 40 of the loop tightening part 4 passes through the first loop 31 in the forefoot portion 20F and the third loop 33 in the rearfoot portion 20R from the tongue 5 of the upper 20 by way of the medial portion 22, from the medial face 1*a* of the footwear 1 to the outside of the footwear 1. Then, the string-like member 40 passes through the second loop 32 at the middle of the loop engagement portion 3 to return from the medial face 1*a* of the footwear 1 and from the outside of the footwear 1 toward the tongue 5 with the loop tightening part 4 interwoven in the loops of the loop engagement portion 3. In this state, the loop engagement portion 3 and the loop tightening part 4 are disposed. The outside of the footwear herein refers to a position separated from the footwear.

The fixing portion 41 is movably provided in the string-like member 40 of the loop tightening part 4 interwoven in the second loop 32 located at the middle of the loop engagement portion 3, through the attachment portion 41*b*. Fixing and release of the fixing portion 41 is performed with respect to the fixed portion 60 provided on the upper 20.

FIG. 3 illustrates a state where the fixing portion 41 of the loop tightening part 4 is fixed to the first fixed member 61 of the fixed portion 60. In FIG. 3, the fixing portion 41 is fixed to the first fixed member 61. As illustrated in FIG. 3, the fixing portion 41 is fixed to the first fixed member 61 with the loop engagement portion 3 pulled by the loop tightening part 4 so that an appropriate fastening force that closes the central opening 20*c* in the width direction in the case of a standard instep height is applied, and a foot 8 accommodated in the internal space 20*a* of the upper 20 is fastened and fixed. In this configuration, one fixing portion 41 is fixed to the fixed portion 60 of the upper 20. Since the loop tightening part 4 is interwoven in the loops of the loop engagement portion 3 in the present embodiment, a tensile force is exerted on the entire loop engagement portion 3 so that the upper 20 can be tightened in a wide range. Accordingly, a tightening effect close to that of a lace-up footwear can be obtained.

FIG. 4 illustrates a state where the fixing portion 41 of the loop tightening part 4 is released from the fixed portion 60. As illustrated in FIG. 4, simply releasing the fixing portion 41 of the loop tightening part 4 from the fixed portion 60 on the upper 20 easily loosens the loop tightening part 4 interwoven in the loops of the loop engagement portion 3, and releases a fastening force of the entire upper 20. In a lace-up footwear, to reduce a fastening force of the entire upper 20, a footwearlace needs to be sequentially loosened from eyelets. On the other hand, in the footwear 1 of the present embodiment, the loosening can be achieved by one action of detaching the fixing portion 41 of the loop tightening part 4 from the fixed portion 60, and the footwear 1 can be easily put on and off.

For tightening, tightening can be easily achieved only by pinching and pulling up the fixing portion 41.

In putting off the footwear 1, the fixing portion 41 of the loop tightening part 4 is released from the fixed portion 60 so that a force can be easily applied in a direction in which the loop tightening part 4 interwoven in the loops of the loop engagement portion 3 is untied. Accordingly, it is possible to easily perform an action of loosening tightening of the upper 20, which takes time for shoelace-type footwears and belt-tightening footwears.

As described above, since the loop engagement portion 3 is located on the medial face 1*a* of the footwear 1 in the present embodiment, holding property at the medial face 1*a* of the footwear 1 can be enhanced, and lowering of the arch of a foot can be reduced.

Then, with reference to FIGS. 6 and 7, an action of putting on the footwear 1 using the loop engagement portion 3 and the loop tightening part 4 will be described.

Figure 6:
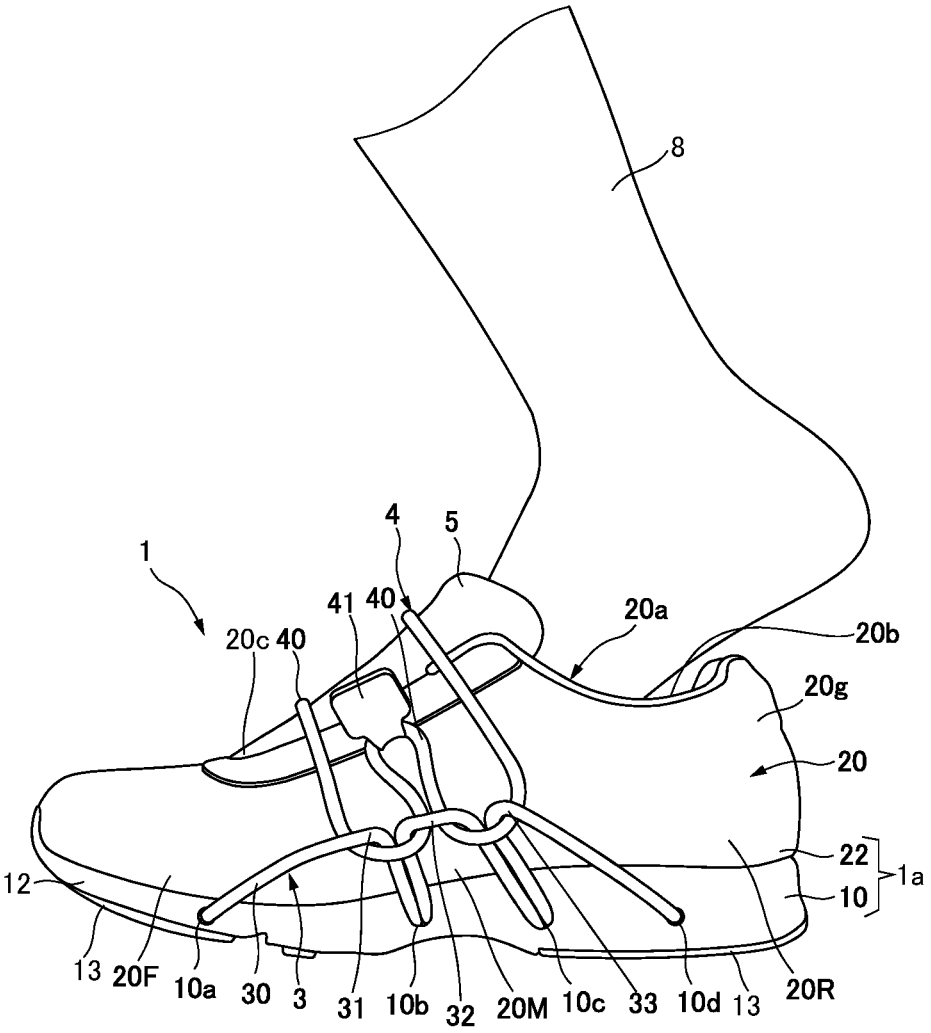
FIG. 6 is a side view of the medial face side illustrating a state where a foot is inserted into the footwear according to the embodiment of the present teaching.

As illustrated in FIG. 6, the fixing portion 41 of the loop tightening part 4 is released from the fixed portion 60, and the loop tightening part 4 interwoven in the loops of the loop engagement portion 3 is loosen. In this state, the foot 8 is inserted from the toe into the internal space 20*a* in the upper 20*a* through the wearing opening 20*b*. At this time, since the entire upper 20 can be greatly loosened, the foot 8 can be easily inserted in the internal space 20*a* in the upper 20.

Figure 7:
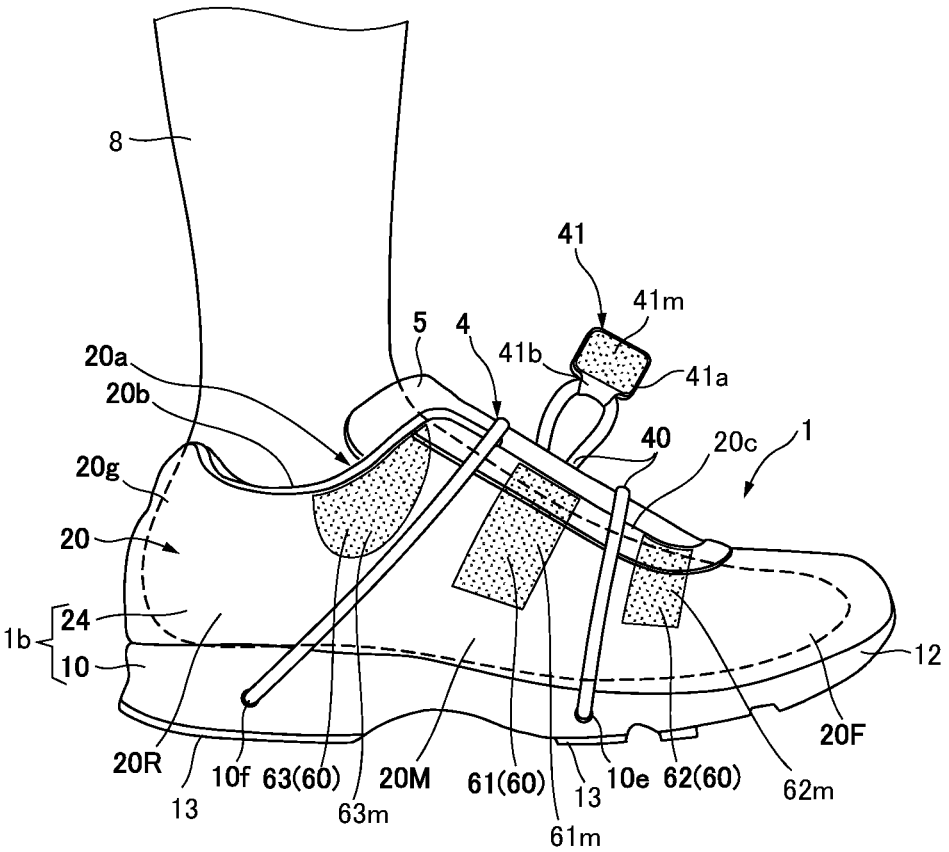

Thereafter, as illustrated in FIG. 7, the fixing portion 41 is pinched and pulled up so that the central opening 20*c* of the upper 20 is closed in the width direction to apply an appropriate fastening force to the entire upper 20. Then, the fixing portion 41 is fixed to the first fixed member 61 with the loop engagement portion 3 pulled by the loop tightening part 4, and thereby, the footwear 1 is put on. Thus, the footwear 1 can be easily put on with one hand, and even a person having difficulty in putting a lace-up footwear on and off can easily put the footwear 1 on and off.

Although the fixed portion 60 is disposed in the upper 20 in the present embodiment, the fixed portion 60 may be provided in the sole 10.

Next, an example of selecting the fixed portion 60 constituted by the fixed members 61, 62, and 63 provided at three positions in accordance with the height of the instep will be described.

In general, as illustrated in FIG. 3, the fixing portion 41 is fixed to the first fixed member 61 provided in the midfoot portion 20M. By fixing the fixing portion 41 to the first fixed member 61 with the loop engagement portion 3 pulled by the loop tightening part 4, an appropriate fastening force of closing the central opening 20*c* in the width direction in the case of a standard instep height is applied, and the foot 8 accommodated in the internal space 20*a* of the upper 20 is fixed by fastening.

Figure 8:
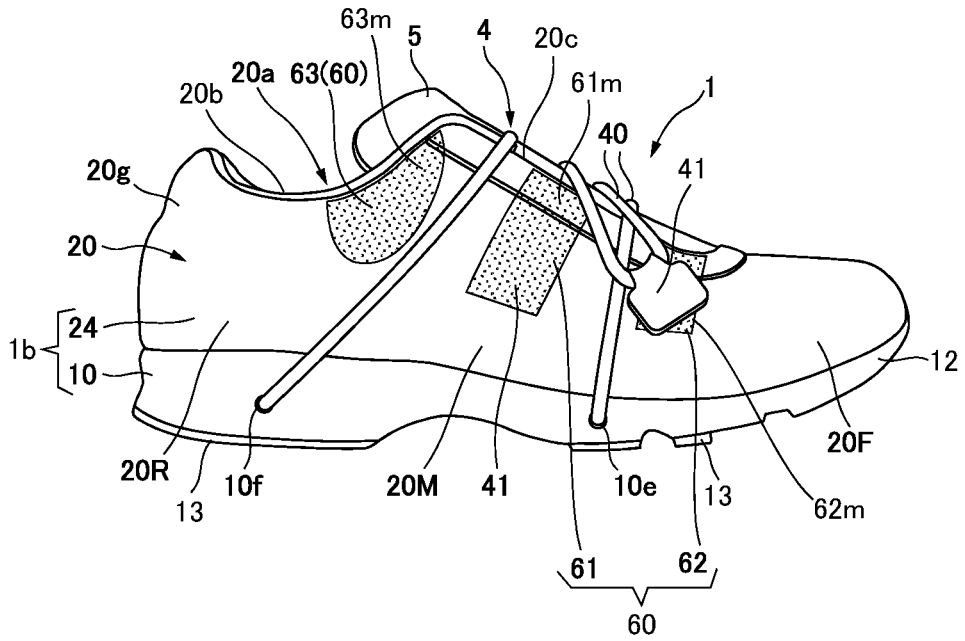
FIG. 8 is a side view of the lateral face side of the footwear according to the embodiment of the present teaching and illustrates a state where the fixing portion of the loop tightening part is fixed to a fixed portion near a forefoot portion of the footwear.

In the case of a low instep, as illustrated in FIG. 8, the fixing portion 41 is fixed to the second fixed member 62 provided in the forefoot portion 20F. By fixing the fixing portion 41 to the second fixed member 62 with the loop engagement portion 3 pulled by the loop tightening part 4, an appropriate fastening force of closing the central opening 20*c* in the width direction in the case of a low instep height is applied, and the foot 8 accommodated in the internal space 20*a* of the upper 20 is fixed by fastening.

Figure 9:
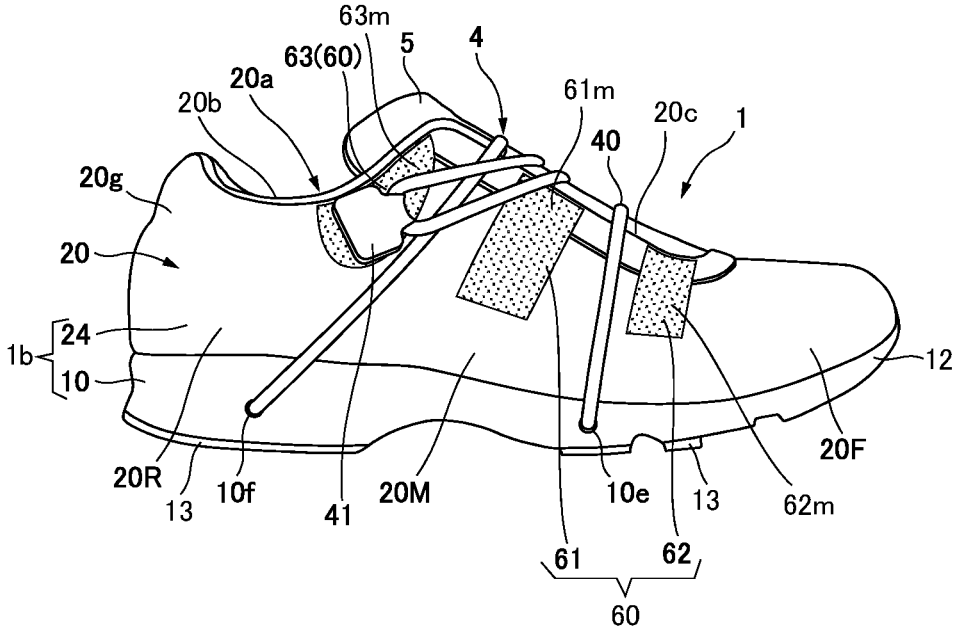
FIG. 9 is a side view of the lateral face side of the footwear according to the embodiment of the present teaching and illustrates a state where the fixing portion of the loop tightening part is fixed to a fixed portion near a wearing opening of the footwear.

In the case of a high instep, as illustrated in FIG. 9, the fixing portion 41 is fixed to the third fixed member 63 provided near the wearing opening 20*b* of the rearfoot portion 20R. By fixing the fixing portion 41 to the third fixed member 63 with the loop engagement portion 3 pulled by the loop tightening part 4, an appropriate fastening force of closing the central opening 20*c* in the width direction in the case of a high instep height is applied, and the foot 8 accommodated in the internal space 20*a* of the upper 20 is fixed by fastening.

In this manner, the fixed portion 60 that is, the first fixed member 61, the second fixed member 62, and the third fixed member 63 are provided at a plurality of positions of the upper 20 so that the fixed members 61, 62, and 63 to which the fixing portion 41 is fixed can be selected in accordance with instep shapes of various persons, and an optimum fastening force can be obtained.

Features of the thus-configured footwear 1 of the present embodiment will be described. The footwear 1 includes a sole 10 and an upper 20 located above the sole 10 to accommodate a foot. The footwear 1 includes: a loop engagement portion 3 located on at least one of a medial face 1*a* or a lateral face 1*b* of the footwear 1, fixed to one of the sole 10, the upper 20, or an interface between the sole 10 and the upper 20, and including a plurality of loops 31, 32, and 33 extending from a lower side toward an upper side; a loop tightening part 4 including a single loop passing through the plurality of loops of the loop engagement portion 3; a fixing portion 41 disposed in a loop tightening part 4; and a fixed portion 60 which is disposed on the upper 20 or the sole 10 and to which the fixing portion 41 is fixed. In a state where the loop engagement portion 3 is pulled by the loop tightening part 4, the fixing portion 41 is fixable to the fixed portion 60. With this configuration, the footwear 1 can be easily put off and on by loosening the loop tightening part 4 including the single loop. In addition, the loop engagement portion 3 and the loop tightening part 4 can tighten the foot inserted in the upper 20 with the upper 20 in a wide range so that the footwear 1 can be effectively tightened independently of an instep shape of a person.

The loop engagement portion 3 is located on one of the medial face 1*a* or the lateral face 1*b* of the footwear 1. The loop tightening part 4 is located on the other face opposite to the face on which the loop engagement portion 3 is located, and is fixed to one of the sole 10, the upper 20, or an interface between the sole 10 and the upper 20. In this case, the loop engagement portion 3 and the loop tightening part 4 apply a fastening force to the upper 20 such that the upper 20 is wrapped from both sides, and the foot inserted in the upper can be tightened by the entire upper.

The loop engagement portion 3 and the loop tightening part 4 are constituted by string-like members 30 and 40. In a case where the loop engagement portion 3 is the string-like member 30, at least one endpoint of the string-like member 30 is fixed to easily configure the plurality of loops 31, 32, and 33. In a case where the loop tightening part 4 is the string-like member 40, the loop tightening part 4 is passed through the plurality of loops 31, 32, and 33 to thereby constitute an interwoven string structure. Accordingly, the upper 20 can be tightened along the instep by pulling up and tightening the loop tightening part 4.

A fixing portion 41 is movable on the loop tightening part 4. In this case, even when the tensile direction of the loop tightening part 4 including the single loop is changed in accordance with, for example, the height of the instep, the fixing portion 41 moves to an appropriate position on the loop tightening part 4, and a tensile force of the loop tightening part 4 in multiple directions is not impaired.

The footwear 1 includes a forefoot portion 20F, a midfoot portion 20M, and a rearfoot portion 20R, and the plurality of loops 31, 32, and 33 of the loop engagement portion 3 are located in the midfoot portion 20M. In this case, the foot can be tightened about the midfoot portion 20M of the footwear 1.

The fixed portion 60 is constituted by a plurality of fixed members 61, 62, and 63, and the fixed members 61, 62, and 63 are located at least in the forefoot portion 20F of the upper 20, in the midfoot portion 20M of the upper 20, and near a wearing opening 20*b* of the upper 20 for inserting the foot. In this case, the fixed members 61, 62, and 63 to which the fixing portion 41 is fixed can be selected in accordance with instep shapes of various persons.

Among the plurality of loops 31, 32, and 33 of the loop engagement portion 3, a front endpoint of the loop 31 at a forefront in a longitudinal direction is located forward of a portion of the footwear 1 corresponding to an MP joint in the longitudinal direction, and a rear endpoint of the loop 33 at a rearmost in the longitudinal direction is located in the rearfoot portion 20R. In this case, the loop engagement portion 3 is disposed on a portion including the midfoot portion 20M so that the upper 20 can be tightened in a wide range.

The loop engagement portion 3 is located on the medial face 1*a* of the footwear 1, and the loop tightening part 4 is located on the lateral face 1*b* of the footwear 1. In this case, holding property at the medial face 1*a* of the footwear 1 can be enhanced, and lowering of an arch of the foot can be reduced.

The loop engagement portion 3 includes three loops 31, 32, and 33 arranged in a longitudinal direction, the loop tightening part 4 is extended from the face opposite to the face on which the loop engagement portion 3 is located to the face on which the loop engagement portion 3 is located, passes through the front loop 31 and the rear loop 33 in the longitudinal direction among the three loops, is folded back toward the face opposite to the face on which the loop engagement portion 3 is located, and passes through the middle loop 32 in the longitudinal direction among the three loops, and the fixing portion 41 is located on a portion of the loop tightening part 4 that has passed through the middle loop 32. In this case, the loop engagement portion 3 and the loop tightening part 4 apply a fastening force to the upper 20 such that the upper 20 is wrapped from both sides, and the foot inserted in the upper can be tightened by the entire upper.

Peak heights of the plurality of loops 31, 32, and 33 gradually increase toward the rearfoot portion. Since the instep becomes higher from the toe toward the heel, the peak heights of the loops are increased in accordance with the height of the instep. Accordingly, the upper 20 can be tightened such that the plurality of loops 31, 32, and 33 of the loop engagement portion 3 extend along the instep.

The peak heights of the plurality of loops 31, 32, and 33 may be parallel to a plane on which the sole 10 is grounded.

The loop engagement portion 3 and the loop tightening part 4 may be constituted by different string-like members.

An exemplary embodiment of the present teaching has been described in detail. The abovementioned embodiment merely describes a specific example for carrying out the present teaching. The embodiment is not intended to limit the technical scope of the present teaching, and various design modifications, including changes, addition, and deletion of constituting elements, may be made to the embodiment without departing from the scope of ideas of the invention defined in the claims. In the aforementioned embodiment, matters to which design modifications may be made are described with the expression of "of the embodiment", "in the embodiment", or the like. However, it is not unallowable to make a design modification to a matter without such expression.

[Modifications]

In the following, modifications will be described. In the drawings and description of the modifications, like reference characters denote like or corresponding constituting elements and members in the embodiment. Repetitive description already provided in the embodiment will be omitted as appropriate, and configurations different from those in the embodiment will be described in detail.

[First Modification]

Figure 10:
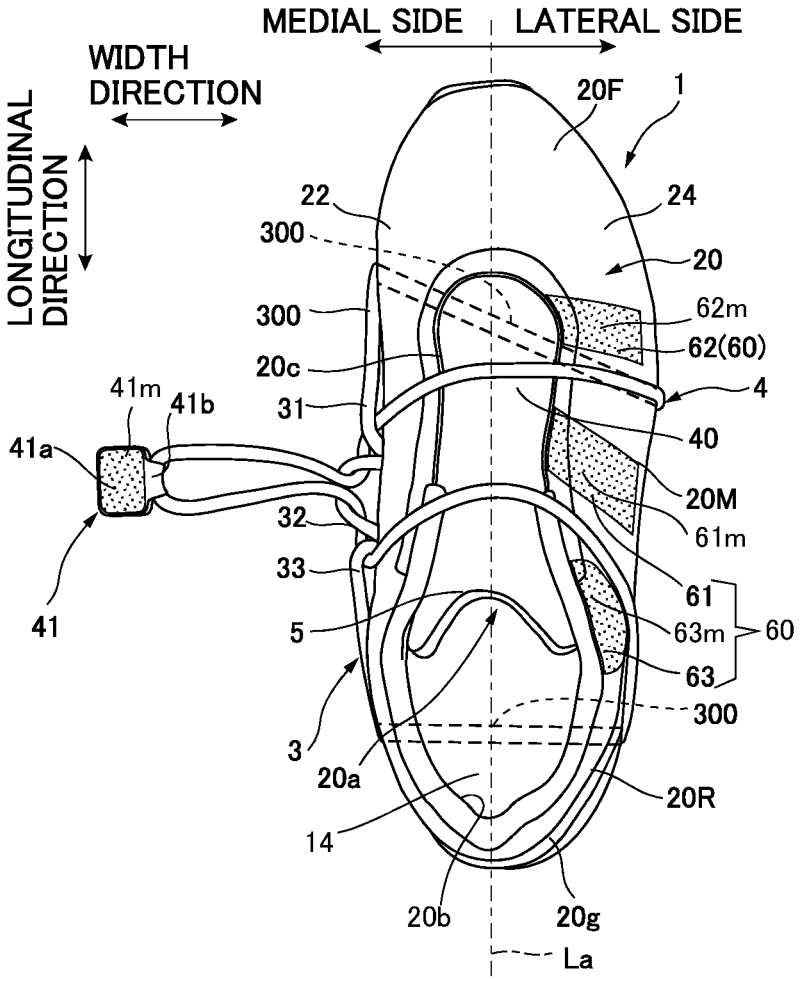
FIG. 10 is a plan view illustrating a footwear according to a first modification of the present teaching.

Although the embodiment describes an example in which the string-like member 30 of the loop engagement portion 3 and the string-like member 30 of the loop tightening part 4 are constituted by different members independent of each other, the present teaching is not limited thereto. FIG. 10 is a plan view illustrating a footwear 1 according to a first modification of the present teaching. In the present modification, the loop engagement portion 3 and the loop tightening part 4 are constituted by a single continuous string-like member 300. To constitute the loop engagement portion 3 and the loop tightening part 4 by the single string-like member 300, in the present modification, the string-like member 300 passes under the insole 14 through the hole 10*a* of the forefoot portion 20F, and passes through the hole 10*e* forward of the loop tightening part 4 to be continuous with the loop tightening part 4. On the other hand, the string-like member 300 constituting the loop engagement portion 3 passes under the insole 14 through the hole 10*d* of the rearfoot portion 20R and passes through the hole 10*f* rearward of the loop tightening part 4 to be continuous with the loop tightening part 4.

In this manner, the loop engagement portion 3 and the loop tightening part 4 are continuous under the insole 14 so that the loop engagement portion 3 and the loop tightening part 4 can be thereby constituted by the single continuous string-like member 300.

[Second Modification]

Figure 11:
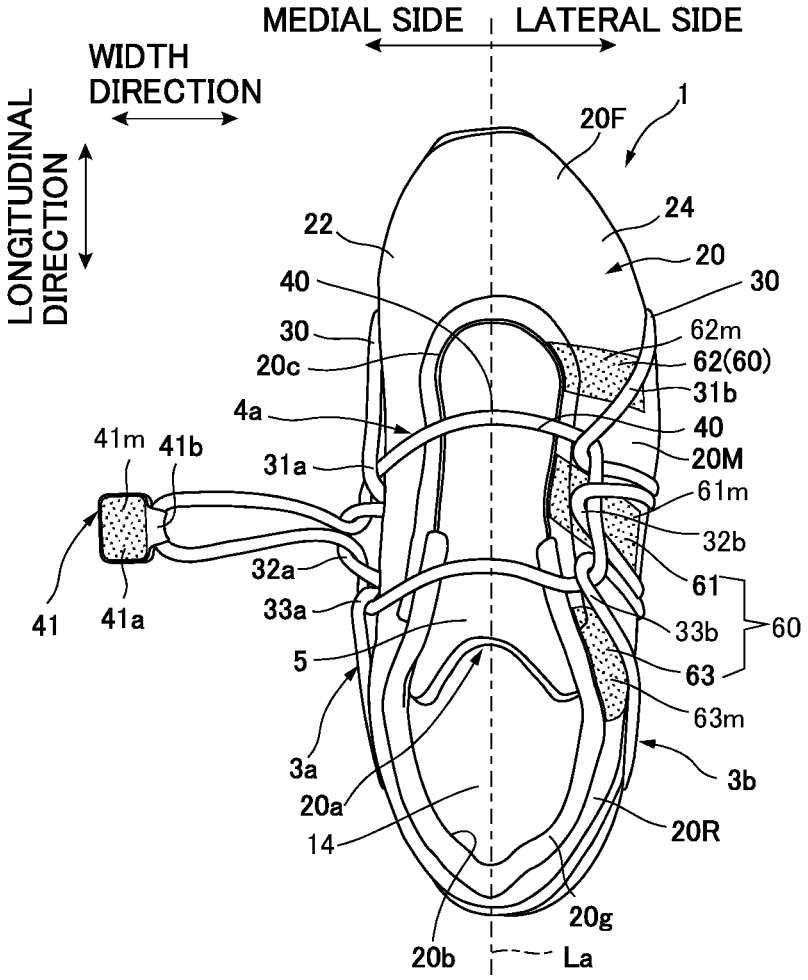
FIG. 11 is a plan view illustrating a footwear according to a second modification of the present teaching.

Although the embodiment describes an example in which the loop engagement portion 3 is located on one of the medial face 1*a* or the lateral face 1*b* of the footwear 1 and the loop tightening part 4 is located on the other face opposite to the face on which the loop engagement portion 3 is located, the present teaching is not limited thereto. FIG. 11 is a plan view illustrating a footwear according to a second modification of the present teaching. In the present modification, a first loop engagement portion 3*a* is located on the medial face 1*a* of the footwear 1, and a second loop engagement portion 3*b* is located on the lateral face 1*b* of the footwear 1. Each of the first loop engagement portion 3*a* and the second loop engagement portion 3*b* includes a plurality of loops. For example, the first loop engagement portion 3*a* includes a first loop 31*a*, a second loop 32*a*, and a third loop 33*a*. The second loop engagement portion 3*b* includes a first loop 31*b*, a second loop 32*b*, and a third loop 33*b*.

A loop tightening part 4*a* including a single loop is provided to be interwoven in the plurality of loops of the first loop engagement portion 3*a* and in the plurality of loops of the second loop engagement portion 3*b*. The loop tightening part 4*a* is not fixed to any of the sole 10, the upper 20, or the interface between the sole 10 and the upper 20.

The loop engagement portions 3*a* and 3*b* are pulled up and tightened by the loop tightening part 4*a*, and the fixing portion 41 disposed on the loop tightening part 4*a* is fixed to the fixed portion 60 of the upper 20.

[Third Modification]

Figure 12:
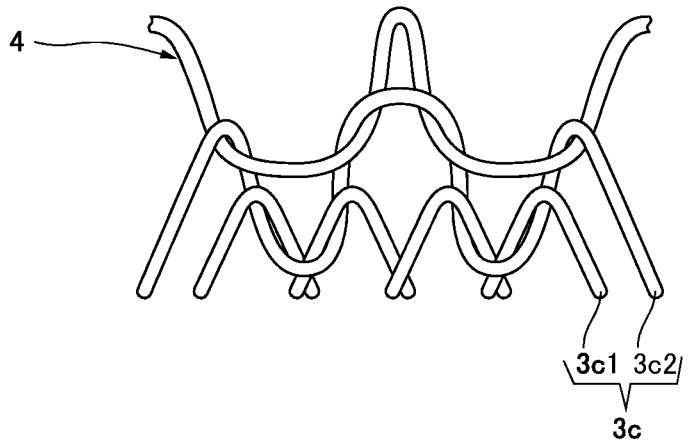
FIG. 12 is a schematic view illustrating a loop engagement portion of a footwear according to a third modification of the present teaching.

Although the embodiment describes an example in which the plurality of loops of the loop engagement portion 3 are constituted by a single level, the present teaching is not limited thereto. A loop engagement portion 3*c* of a third modification can be configured such that a plurality of loops are interwoven in multiple levels, the number of loops in an upper level is smaller than in a lower level, and the uppermost level is formed of three loops. FIG. 12 is a schematic view illustrating a loop engagement portion of a footwear according to the third modification of the present teaching, and illustrates an example in which the loop engagement portion has two levels.

In the modification illustrated in FIG. 12, a loop engagement portion 3*c*1 at a first level includes four loops, and loops at a second level are interwoven in these four loops. A loop engagement portion 3*c*2 at the second level includes three loops. The loop tightening part 4 is interwoven in the loops at the second level.

Figure 13:
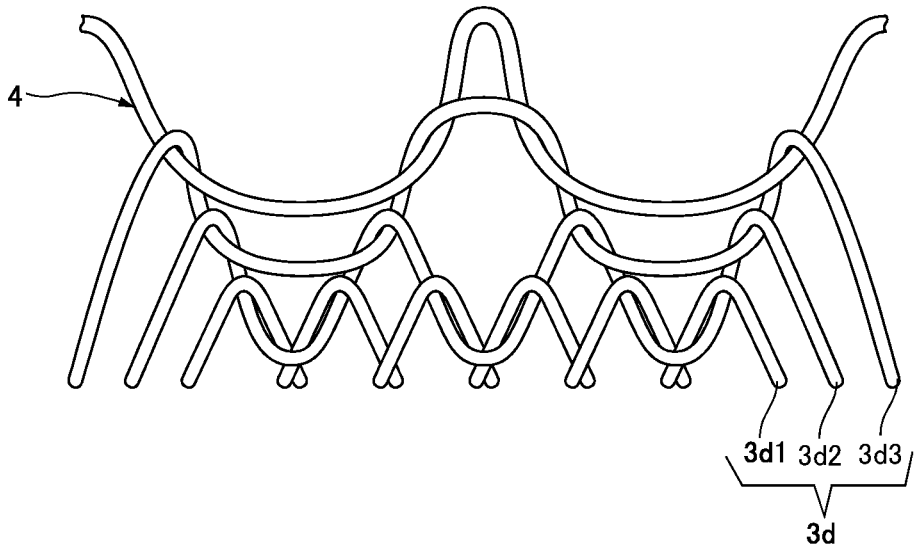
FIG. 13 is a schematic view illustrating another loop engagement portion of the footwear according to the third modification of the present teaching.

FIG. 13 is a schematic view illustrating another loop engagement portion of the footwear according to the third modification of the present teaching. In the modification illustrated in FIG. 13, the loop engagement portion 3*d* has three levels. A loop engagement portion 3*d*1 at a first level includes six loops, and loops at a second level are interwoven in these six loops. A loop engagement portion 3*d*2 at the second level includes four loops. Loops at a third level are interwoven in these four loops. A loop engagement portion 3*d*3 at the third level includes three loops. The loop tightening part 4 is interwoven in the loops at the third level.

In this manner, in the case of increasing the number of loops of the loop engagement portion, the configuration can be easily obtained by constituting the loop engagement portion in multiple levels.

[Other Modifications]

Although the embodiment describes an example in which the loop engagement portion 3 and the loop tightening part 4 are exposed to the outside of the upper 20, the present teaching is not limited thereto. At least a portion of the loop engagement portion 3 and the loop tightening part 4 may be disposed inside the upper 20. In the present teaching, the folding structure can be reduced as compared to a footwear with a belt-tightening structure, and thus, the overlapping amount between the loop engagement portion 3 and the loop tightening part 4 decreases. Accordingly, at least a portion of the loop engagement portion 3 and the loop tightening part 4 can be easily disposed inside the upper 20. Such a footwear 1 is preferable as a footwear for use in sports including contact play and so forth.

In the description of the embodiment, the loop engagement portion 3 is located on the medial face 1*a* of the footwear 1, and the loop tightening part 4 is located on the lateral face 1*b* of the footwear 1, but the present teaching is not limited thereto. The loop tightening part 4 may be located on the medial face 1*a* of the footwear 1 with the loop engagement portion 3 located on the lateral face 1*b* of the footwear 1. Since the loop engagement portion 3 is located on the lateral face 1*b* of the footwear 1, in performing an action such as outward sliding, the effect of preventing a foot from falling down from the sole 10, so-called lateral bulging, is expected.

In the example described in the embodiment, the loop engagement portion 3 and the loop tightening part 4 are located on different side faces of the footwear 1, but the present teaching is not limited thereto. The loop engagement portion 3 and the loop tightening part 4 may be located on the same side face of the footwear 1. In this case, the fixed portion 60 is located on the upper 20 or the sole 10 at a side face opposite to the side face on which the loop engagement portion 3 and the loop tightening part 4 are located.

In the example described in the embodiment, the upper heel portion 20*g* for covering the heel of the foot is provided rearward of the wearing opening 20*b* in the upper 20, but the present teaching is not limited thereto. The present teaching is also applicable to a footwear 1 in which the upper 20 does not include the upper heel portion 20*g*, that is, a sandal.

Each of the abovementioned modifications provides functions and effects similar to those of the aforementioned embodiment.

Optional combinations of the aforementioned embodiment and modifications may also be practiced as additional embodiments of the present teaching. Such an additional embodiment made by combination has the effect of each of the combined embodiment and modifications.

INDUSTRIAL APPLICABILITY

The present teaching is applicable to a footwear in which an upper is tightened.

Features disclosed herein include the following:

(1) A footwear including: a sole; an upper provided above the sole to accommodate a foot; a loop engagement portion located on at least one of a medial face or a lateral face of the footwear, fixed to one of the sole, the upper, or an interface between the sole and the upper, and including a plurality of loops extending from a lower side toward an upper side; a loop tightening part including a single loop passing through the plurality of loops of the loop engagement portion; a fixing portion disposed in the loop tightening part; and a fixed portion which is disposed on the upper or the sole and to which the fixing portion is fixed, wherein in a state where the loop engagement portion is pulled by the loop tightening part, the fixing portion is fixable to the fixed portion.

(2) The footwear of (1), wherein the loop engagement portion is located on one of the medial face or the lateral face of the footwear, and the loop tightening part is located on another of the medial face or the lateral face opposite to the one face, fixed to one of the sole, the upper, or the interface between the sole and the upper, and extending from the sole toward the upper.

(3) The footwear of (1) or (2), wherein each of the loop engagement portion and the loop tightening part is constituted by a string-like member.

(4) The footwear of any one of (1) to (3), wherein the fixing portion is movable on the loop tightening part.

(5) The footwear of any one of (1) to (4), wherein the footwear includes a forefoot portion, a midfoot portion, and a rearfoot portion, and the plurality of loops of the loop engagement portion are located in the midfoot portion.

(6) The footwear of (5), wherein the fixed portion includes a plurality of fixed members, and the fixed members are disposed at least in the forefoot portion of the upper, in the midfoot portion of the upper, and near a wearing opening of the upper for inserting the foot.

(7) The footwear of any one of (1) to (6), wherein among the plurality of loops of the loop engagement portion, a front endpoint of the loop at a forefront in a longitudinal direction is located forward of a portion of the footwear corresponding to an MP joint in the longitudinal direction, and a rear endpoint of the loop at a rearmost in the longitudinal direction is located in the rearfoot portion.

(8) The footwear of any one of (1) to (7), wherein the loop engagement portion is located on the medial face of the footwear, and the loop tightening part is located on the lateral face of the footwear.

(9) The footwear of (2) or (3), wherein the loop engagement portion includes three loops arranged in a longitudinal direction, and the loop tightening part is extended from the face opposite to the face on which the loop engagement portion is located to the face on which the loop engagement portion is located, passes through front and rear loops in the longitudinal direction among the three loops, is folded back toward the face opposite to the face on which the loop engagement portion is located, and passes through a middle loop in the longitudinal direction among the three loops, and the fixing portion is disposed on a portion of the loop tightening part that has passed through the middle loop.

(10) The footwear of any one of (1) to (3), wherein in the loop engagement portion, a plurality of loops are interwoven in multiple levels, the number of loops at an upper level is smaller than the number of loops at a lower level, and an uppermost level is formed of three loops.

(11) The footwear of any one of (1) to (3), wherein peak heights of the plurality of loops are parallel to a plane on which the sole is grounded.

(12) The footwear of (5), wherein peak heights of the plurality of loops gradually increase toward the rearfoot portion.

(13) The footwear of any one of (1) to (12), wherein at least a part of one of the loop engagement portion or the loop tightening part is located inside the upper.

(14) The footwear of (3), wherein the loop engagement portion and the loop tightening part are constituted by a single continuous string-like member.

(15) The footwear of (3), wherein the loop engagement portion and the loop tightening part are constituted by different string-like members.

REFERENCE SIGNS LIST

1: footwear
1*a*: medial face
1*b*: lateral face
3: loop engagement portion
4: loop tightening part
5: tongue
10: sole
20: upper

20F: forefoot portion
20M: midfoot portion
20R: rearfoot portion
20*a*: internal space
20*b*: wearing opening
20*c*: central opening
20*g*: upper heel portion
22: medial portion
24: lateral portion
30: string-like member
40: string-like member
41: fixing portion

The invention claimed is:

1. A footwear, comprising:

a sole;

an upper provided above the sole to accommodate a foot;

a loop engagement portion located on at least one of a medial face or a lateral face of the footwear, fixed to one of the sole, the upper, or an interface between the sole and the upper, and including a plurality of loops extending from a lower side toward an upper side;

a loop tightening part including a single loop passing through the plurality of loops of the loop engagement portion;

a fixing portion disposed on the loop tightening part; and a fixed portion which is disposed on the upper or the sole and to which the fixing portion is fixed, wherein:

in a state where the loop engagement portion is pulled by the loop tightening part, the fixing portion is fixable to the fixed portion, the loop engagement portion is located on the medial face of the footwear and the loop tightening part is located on the lateral face of the footwear, or the loop engagement portion is located on the lateral face of the footwear and the loop tightening part is located on the medial face of the footwear, the loop tightening part is fixed to one of the sole, the upper, or the interface between the sole and the upper, and extending from the sole toward the upper, the loop engagement portion includes three loops arranged in a longitudinal direction, and the loop tightening part is extended from the face opposite to the face on which the loop engagement portion is located to the face on which the loop engagement portion is located, passes through front and rear loops in the longitudinal direction among the three loops, is folded back toward the face opposite to the face on which the loop engagement portion is located, and passes through a middle loop in the longitudinal direction among the three loops, and the fixing portion is disposed on a portion of the loop tightening part that has passed through the middle loop.

2. The footwear according to claim 1, wherein each of the loop engagement portion and the loop tightening part is constituted by a string-like member.

3. The footwear according to claim 2, wherein the fixing portion is movable on the loop tightening part.

4. The footwear according to claim 2, wherein the loop engagement portion and the loop tightening part are constituted by a single continuous string-like member.

5. The footwear according to claim 2, wherein the loop engagement portion and the loop tightening part are constituted by different string-like members.

6. The footwear according to claim 1, wherein the footwear includes a forefoot portion, a midfoot portion, and a rearfoot portion, and the plurality of loops of the loop engagement portion are located at least in the midfoot portion.

7. The footwear according to claim 6, wherein the fixed portion includes a plurality of fixed members, the fixed members being disposed at least in the forefoot portion of the upper, in the midfoot portion of the upper, and near a wearing opening of the upper for inserting the foot.

8. The footwear according to claim 6, wherein the plurality of loops of the loop engagement portion includes a forward loop and a rearward loop, the forward loop having a front endpoint located forward of a portion of the footwear corresponding to a metatarsophalangeal joint in the longitudinal direction, and the rearward loop having a rear endpoint located in the rearfoot portion.

9. The footwear according to claim 6, wherein peak heights of the plurality of loops gradually increase toward the rearfoot portion.

10. The footwear according to claim 1, wherein the loop engagement portion is located on the medial face of the footwear, and the loop tightening part is located on the lateral face of the footwear.

11. The footwear according to claim 1, wherein in the loop engagement portion, a plurality of loops are interwoven in multiple levels, the number of loops at an upper level is smaller than the number of loops at a lower level, and an uppermost level is formed of three loops.

12. The footwear according to claim 1, wherein peak heights of the plurality of loops are parallel to a plane on which the sole is grounded.

13. The footwear according to claim 1, wherein at least a part of one of the loop engagement portion or the loop tightening part is located inside the upper.

* * * * *